US005172532A

United States Patent [19]

Gibbar, Jr.

[11] Patent Number: 5,172,532

[45] Date of Patent: Dec. 22, 1992

[54] PREFABRICATED POLYMER BUILDING WALL PANELS

[76] Inventor: James H. Gibbar, Jr., 1100 Lottes St., Perryville, Mo. 63775

[21] Appl. No.: 744,474

[22] Filed: Aug. 12, 1991

Related U.S. Application Data

[63] Continuation-in-part of Ser. No. 522,327, May 11, 1990, Pat. No. 5,038,541, which is a continuation-in-part of Ser. No. 176,650, Apr. 4, 1988, Pat. No. 4,924,641.

[51] Int. Cl.[5] ..... E04C 1/00

[52] U.S. Cl. ..... 52/309.12

[58] Field of Search ..... 52/405, 309.12

[56] References Cited

U.S. PATENT DOCUMENTS

| | | | |
|---|---|---|---|
| 994,027 | 5/1911 | O'Beirne . | |
| 2,181,698 | 11/1939 | Langenberg . | |
| 3,149,437 | 9/1964 | Wheeler-Nicholson . | |
| 3,220,151 | 11/1965 | Goldman . | |
| 3,552,076 | 10/1968 | Gregori . | |
| 3,584,826 | 6/1971 | Liester . | |
| 3,599,384 | 8/1971 | Carlson | 52/309.12 |
| 3,689,021 | 9/1971 | Liester . | |
| 3,788,020 | 1/1974 | Gregori . | |
| 3,908,326 | 9/1975 | Francis . | |
| 4,055,928 | 11/1977 | Magerle | 52/405 |
| 4,229,920 | 10/1980 | Lount . | |
| 4,234,634 | 11/1980 | Longinotti . | |
| 4,288,956 | 9/1981 | Heck | 52/309.12 |
| 4,426,061 | 1/1984 | Taggart . | |
| 4,439,967 | 4/1984 | Dielenberg . | |
| 4,516,372 | 5/1985 | Grutsch . | |
| 4,577,447 | 3/1986 | Doran . | |
| 4,578,915 | 4/1986 | Schneller . | |
| 4,604,843 | 8/1986 | Ott et al. . | |
| 4,706,429 | 11/1987 | Young . | |
| 4,731,968 | 3/1988 | Obino | 52/309.12 |
| 4,866,891 | 9/1989 | Young | 52/309.12 |
| 4,924,641 | 5/1990 | Gibbar . | |
| 4,949,515 | 8/1990 | Krecke | 52/309.12 |

FOREIGN PATENT DOCUMENTS

| | | | |
|---|---|---|---|
| 2240325 | 7/1975 | France | 52/309.12 |

*Primary Examiner*—David A. Scherbel
*Assistant Examiner*—Creighton Smith
*Attorney, Agent, or Firm*—Paul M. Denk

[57] ABSTRACT

A prefabricated polymer building wall panel, generally formed of polystyrene, as a slab, is sculpted to form grooves therein, by hot wire cutting, or by other cutting means, and into which reinforcement rods may be located, in preparation for the pouring or pumping of concrete therein, to form a concrete built skeletal structure for reinforcing the panel, as they are erected into a building wall structure. Vermiculite, lightweight concrete, or polystyrene sheet is applied over the open grooved side of the polystyrene sheet, either before or after concrete is poured therein, to provide either an outer or inner surface for the building wall, when erected, and slots are provided along each side or upper or lower edge of each panel, so that the panels can be assembled, either side by side, or one above the other, during their erection. The grooves cut into the polystyrene panel may be design shaped, as in the configuration of an I-beam, in cross section, for enhanced reinforcement and to strengthen the panels for fabrication into a building wall.

7 Claims, 1 Drawing Sheet

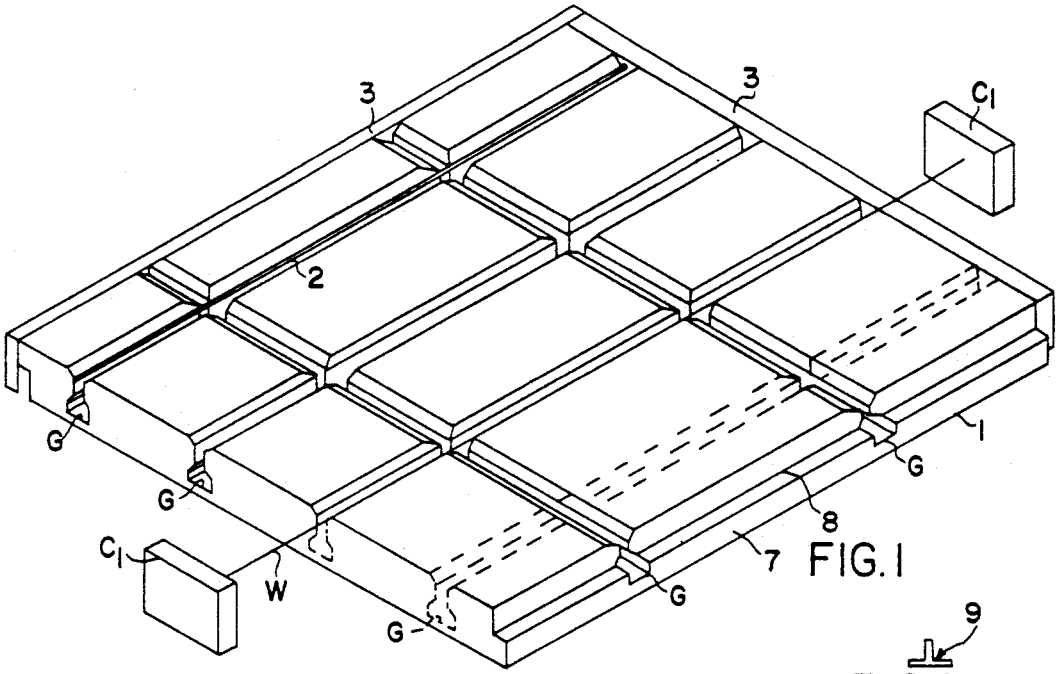
FIG.1
FIG.6
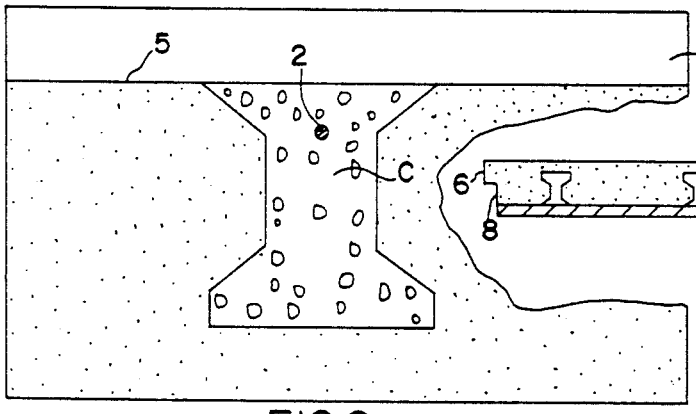
FIG.2
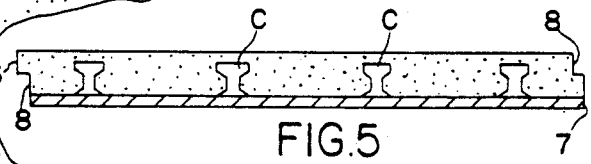
FIG.5
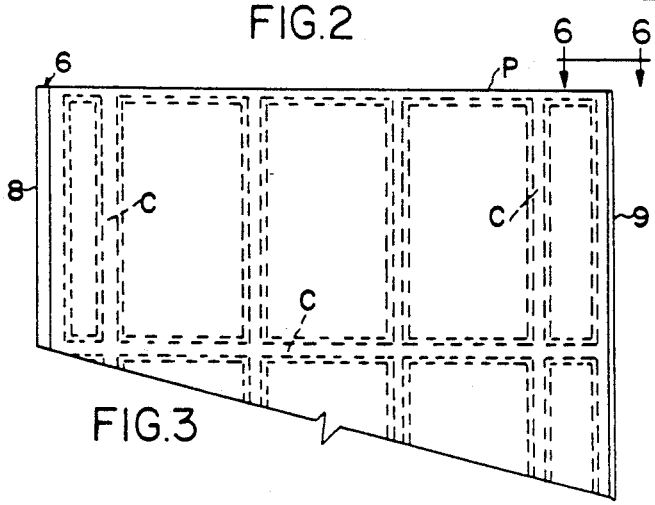
FIG.3
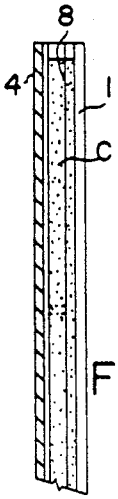
FIG.4

PREFABRICATED POLYMER BUILDING WALL PANELS

CROSS-REFERENCE TO RELATED APPLICATIONS

The subject matter of this application is related to and comprises a continuation-in-part of U.S. patent application having Ser. No. 07/522,327, filed on May 11, 1990, now U.S. Pat. No. 5,038,541 which application is designated as a continuation-in-part of the patent application to the same inventor filed on Apr. 4, 1988, Ser. No. 07/176,650, and now U.S. Pat. No. 4,924,641, all of which disclosures are incorporated herein, by reference.

BACKGROUND OF THE INVENTION

This invention relates generally to the formation of wall panels, and more specifically relates to the formation of prefabricated polymer building wall panels, which can he constructed at the factory, easily transported, and conveniently handled at the job site for erecting into a building wall.

A large number of wall structures, designed to ease and reduce the expense of fabrication of building walls, foundation walls, or the like, have long been available in the art. A variety of U.S. patents disclose such, such as in the patent to Longinotti, No. 4,234,634, upon a prefabrication system for building walls. The patent to Grutsch, No. 4,516,372, shows another form of concrete frame work, for use for constructing a plurality of panels. Furthermore, the patent to Ott, et al, No. 4,604,843, discloses what is identified as a lost-form concrete falsework. The latter patent likewise discloses the arrangement of bridging members, apparently useful for forming the wall, before the concrete is poured. Other U.S. patents include the patent to O'Beirne, U.S. Pat. No. 994,027, which discloses interlocking concrete panels. The patent to Langenberg, U.S. Pat. No. 2,181,698, discloses another form of wall construction. In this instance, the wall is formed of various inner and outer slabs, which are interlocked together by means of connecting ties. The patent to Wheeler Nicholson, U.S. Pat. No. 3,149,437, discloses a further form of building construction. The forms used therein are quite complex of fabrication, as can be seen. The U.S. patent to Goldman, U.S. Pat. No. 3,220,151, shows a building unit with laterally related interfitting panel sections. The patent to Gregori, U.S. Pat. No. 3,552,076, discloses another type of concrete form, made of prefabricated polymer, such as polystyrene units, which are layered in place. The patent to Liester, U.S. Pat. No. 3,584,826, discloses another type of concrete wall forming apparatus and method, as does the second patent to Liester, U.S. Pat. No. 3,689,021. A further patent to Gregori, U.S. Pat. No. 3,788,020, discloses a foamed plastic concrete type of form with fire resistant tension members. The patent to Francis, U.S. Pat. No. 3,908,326, shows a development entitled "A Brick Panel Construction." The patent to Lount, U.S. Pat. No. 4,229,920, shows another type of foamed plastic concrete forms, and connectors therefor. The U.S. patent to Taggart, U.S. Pat. No. 4,426,061, shows yet another form of method and apparatus for forming insulated walls. The patent to Dielenberg, U.S. Pat. No. 4,439,967, discloses an apparatus relating to building form work. The U.S. patent to Doran, No. 4,577,447, discloses a construction block, formed as a building block, and apparently constructed of polystrene beads. The patent to Schneller, U.S. Pat. No. 4,578,915, shows another form of exterior wall. The patent to Young, U.S. Pat. No 4,706,429, discloses a permanent non-removable insulating type concrete wall forming structure.

Finally, various publications have defined the construction of foam homes, which are generally panels prefabricated of foam material, and which interfit together into some type of geodesic shape for furnishing a building structure.

It is, therefore, the principal object of the current invention to provide a prefabricated polymer building wall panel, which is custom cut to accommodate the flow of concrete therein, for reinforcing purposes, into a skeletal type reinforcing structure, and which prefabricated forms can then be shipped to the job site for erection.

Another object of this invention is to provide a prefabricated polymer wall form, basically formed of polymer foam material, and therefore being reasonably lightweight, to accommodate their ease of handling and transmittal to the job site for erection into a sizable building wall.

Still another object of this invention is to provide a series of prefabricated panels, being reinforced with concrete, lighweight concrete, or the like, which is arranged and oriented in a variety of angular directions, generally vertically and horizontally disposed, within the wall structure, to add to its reinforcement, and its load bearing characteristics.

Still another object of this invention is to provide a prefabricated building wall panel, reinforced with concrete, and which further contains metal reinforcing rods, to add significantly to its ability to withstand tension and compressive forces, in addition to lateral wind loads.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the formation of prefabricated wall forms, preferably constructed of foamed polymer, and more specifically polymer such as polystyrene, foamed polyurethane, and the like. Generally, a sizable sheet, normally a four by eight feet sheet in dimensions, or larger, is laid flat on a surface, at the factory, or in some instances, at the job site, and is hot wire cut to contain a series of grooves therein, normally configured in the shape of I-beams, and which subsequently have a series of one or more reinforcing rods located therein, at which time concrete is poured or pumped into the form, to provide a skeletal reinforcing structural work that reinforces the lightweight foamed wall, once assembled. Once the reinforced panel is filled with concrete, to provide it with its desired reinforcement, an outer panel, generally of thinner dimension than the polystyrene panel, is applied thereon, and adhered thereto by means of an adhesive, or other fastener, in order to form the prefabricated panel. The panel will have been previously cut to provide it with slots extending, normally vertically, along the edges of each panel, so that the panels can be interfitted together, at the job site, in order to complete a building wall. T tracks are placed between the panels, as they are erected, and it is to these tracks that other interior or exterior finishing surfaces may be applied, to add the various finishing facade to the structure, and the building wall, for its completion. On the other hand, it is likely that the T tracks may be left off when not needed, as when the panel wall may be prefinished either at the factory, or finished at the job site, as the building is being erected.

The concept of this invention for forming prefabricated foamed wall panels is designed to be either load or non-load bearing, when forming a structural wall system for a building, whether it be a commercial building, warehouse, or even a home.

Furthermore, the lighweight concrete panel that is applied to the outer surface of the foamed panel, once the concrete has been applied therein, may be just that, either a lightweight concrete, or vermiculite, or any other type of sheet of material that has similar dimensions to that of the concrete reinforced foamed panel, in order to provide a finish to the prefabricated panel at the factory, or even to add other characteristics, such as fire proofing, etc.

In addition, the shape provided to the grooves formed within the foamed polymer, when initiating its processing, may be cut to the configuration of an I-beam, in cross section, as through the use of what is ;identified in the trade as a hot wire cutter, which is normally an electrified wire, that heats up, through its resistance, to approximately at least two hundred degrees, and which can cut the polystyrene quite easily, to any shape and configuration desired, during its prefabrication. Obviously, other forms of cutters may be applied. Furthermore, before the concrete is applied into the cut grooves, and after the reinforcing rods will have been located therein, forms, such as two by eights, or the like, may be applied to the peripherial edges of the foamed polymer, in order to close off the ends, when concrete is poured therein. On the other hand, as previously alluded to, the vermiculite, or lightweight concrete panel may be applied to the top of the cut polystyrene form, and then concrete forms placed around the perimeter of the assembled wall panel, at which time lightweight concrete may be pumped under pressure, into the arranged grooves, to complete the concrete reinforcement for the prefabricated panel.

BRIEF DESCRIPTION OF THE DRAWING

In referring to the drawing, FIG. 1 provides an isometric view of the foamed polymer sheet for the prefabricated panel disclosing the concrete receptive reinforcing grooves disposed therein;

FIG. 2 provides a partial end view, of a formed panel, disclosing the foamed polymer sheet, the concrete reinforcement shaped in the configuration of an I-beam, and having the lightweight concrete or other sheet applied thereon;

FIG. 3 is a top plan view of a part of the prefabricated polymer building wall panel, disclosing the concrete reinforcement extending at various angular relationships throughout the panel;

FIG. 4 is an edge view of a part of a prefabricated panel during its erection;

FIG. 5 is an end view of a prefabricated polymer building wall panel; and .

FIG. 6 shows a T track for panel edge connection.

DESCRIPTION OF THE PREFERRED EMBODIMENT

In referring to the drawing, and in particular FIG. 1, the basic configuration of a component of the prefabricated polymer building wall panel of this invention is disclosed. In this particular instance, it comprises a sheet of foamed polymer, as at 1, which may comprise a slab of polystyrene, and the usual dimensions for such a sheet, to facilitate its handling, will be in the range of four feet in width, eight feet in length, and approximately seven inches, plus or minus, in thickness. As can be seen, the sheet is generally laid upon a flat surface, as at the factory, or at the job site, and is cut by means of a hot wire cutter, as disclosed at C, which spans a wire filament W along the length dimension of the foam panel, the wire is charged with a degree of current, so as to achieve a temperature within a range of two hundred degrees, or more, and at that time, is design shifted to cut the styrofoam (which is a trademark for an expanded synthetic resinous material) in the configuration of a variety of grooves, as shown at G, to prepare the slab for reception of concrete, that will be poured therein to provide for reinforcement for the prefabricated panel. As noted, these grooves G are cut to any desired configuration, in cross section, but as shown, are usually configured in the shape of an I beam, as noted. Furthermore, these grooves may extend lengthwise and/or heightwise of the panel, and crosswise, so as to provide a skeletal gridwork for reinforcement of the panel, so that it can become a load bearing panel, if desired. Once the grooves are cut, they will have preferably located therein one or more reinforcing rods, one as shown at 2, and which will be positioned, as can be seen in FIG. 2, at a location where tension may be encountered by the wall panel, when it is erected for usage within a building structure. Such reinforcement may be applied along each of the formed grooves, once cut, or the reinforcing rods may only be located where additional strength is required, in order to enhance the load bearing characteristics of the panel, to be fabricated into the building wall. Once the grooves G are cut, preferably, some type of forming, as through the use of the forms 3, as noted at least along two of the walls, may be provided, so that when concrete is poured in the cut grooves, it will prevent spillage out of the sides, and sustain it within the grooves, until hardened and curing commences.

Once the reinforced concrete C is set, a final layer of the lightweight concrete, vermiculite, or even another sheet of polystyrene, as at 4, may be applied to the upper surface of the sheet 1, and adhesively connected in place, as can be seen along the juncture, as at 5, to seal the reinforcement of concrete in place, and to actually conceal it from view, in the prefabricated panel. The side edges 6 and 7 of each panel may be cut, or previously formed, to contain a step or slot, as at 8, at each side edge of a panel, so that when adjacent panels are erected into the wall form, as can be seen, since the slots are arranged in opposite directions at each side edge of a panel, they can be interfitted together, as adjacent panels are aligned, and erected, into the building structure. This can be seen in FIG. 5, disclosing the location of the oppositely directed slide slots 8, within a panel design.

A frontal view of one of the wall panels is disclosed, partially, in FIG. 3, and the panel P discloses the location of the concrete reinforcement, arranged both vertically and horizontally within the structured panel, when completed. Also shown in FIG. 3, and disclosed in an upper end view in FIG. 6, is the type of T track 9 that is useful for locating along each side edge of a wall panel, as they are assembled, and can be tied in position in a manner similar to the use of the horizontally disposed T-shaped ties 10, as shown in my earlier application and patent, and which disclosure is incorporated herein by reference. These ties are useful for placing between panels, both vertically, or horizontally, when the panels are erected in either fashion, to help support the form and to provide an interior and/or exterior fastening surface to which various finishing materials may be applied. Interiorly, this may be paneling, decorative plasterboard, or the like, that provides a finished wall interiorly of the building; and exteriorly, may be any type of veneer or other brickwork, or brick paneling, that is applied to the T tracks, upon the outer surface of the wall, to give it a more complete, exterior grade finish. On the other hand, such T tracks may be left off when not needed, particularly when the paneled walls may be prefinished or finished either in the factory, or at the job site, utilizing other finishing means, such as stucco, or the like.

As can be seen in FIG. 4, which is a side edge view of one of the panels, the lightweight concrete or vermiculite layer 4 is shown in its erected position, at an exterior location for the panel, with the foamed polystyrene sheet 1, with its side edge step 8, being readily disclosed. The concrete reinforcement can be generally noted at C. It can further be seen that the side slots 8 generally have a dimension of approximately half the width of the completed panel, with the vermiculite slab thereon, so that flush mounting of adjacent panels can be made, when a series of them are erected either vertically, or horizontally, into a completed building wall, during their assembly.

The purpose of this invention, as disclosed, is to provide a precast panel wall for commercial and industrial applications, or for all type buildings, and both for load and non-load bearing walls. The panel preferably will be produced at the factory, or it may be assembled at the job site itself. Its system for manufacture is basically performed in three stages, initially, as previously explained, the slab of polystyrene is sculptored, by means of the hot wire or other type cutting, to create reasonably precisely the engineered, dimensional grooves that merge both horizontally and vertically within the sheet, wherein the patterned reinforcement is required. The second step, once concrete has been poured into the grooves, after its forming, a sheet of either polystyrene, approximately one or two inches in thickness, or more, or a sheet of lightweight concrete, or vermiculite, is glued or otherwise adhered to the open-cavity side of the sculpted slab, creating a form for confining concrete and reinforcement within the wall. The concrete can be either poured before the upper thinner slab is glued thereon, or it can be pumped into the cavities, after the upper sheet is glued thereon, and the outer perimeter of the panel formed, so as to accommodate the flow of concrete, under pressure, into all interstices of the formed cavities or grooves. Generally, this concrete emplacement will be performed at the factory, although it could be done at the job site itself. The finished panels then include the side slots or steps 8, as previously explained, which may be either precut into the polystyrene, or cut after the panels are formed. The panels are designed, in the preferred embodiment, as either four feet by eight feet, or eight feet by four feet, as either vertical or horizontal panels, respectively. Several panels can be joined together, or have the concrete poured therein after the panels are joined together, in order to form a "mega" type of panel. These panels could be assembled up to multifeet in height and width, as much as forty feet or more, as may be required. The present designs for wall forms, of the current invention, while normally being a four feet by eight feet prefabricated panel, also includes the fabrication of panels as eight feet by thirty feet by eight inch panel sections, or to other related dimensions.

The final step, once the panels are being assembled, is to locate the T track placed between panels both vertically and horizontally, and both on the front and back walls, where required, and can be tied in position by means of cross wires, as explained in my earlier application, so as to support the form in place, and provide interior and/or exterior fastening surfaces for appending various finishing materials thereto, as previously explained. However, as also previously referred to, the T track may be left off, when it is not needed in a wall panel, when some other form of finish may be applied, such as stucco.

The industrial panels of this invention may be designed as either load or non-load bearing structural wall systems, as in the commercial panel wall, as such may be required. In the commercial wall panel, it is preferable that the vermiculite insulation sheet, as a lightweight type concrete, be adhered to the open cavity side of the sculpted and grooved polystyrene slab, so as to create the form, and then locate side bracings or side forms, as at 3, thereon, to accommodate the pumping or pouring of concrete therein, either in the factory, or at the job site, in order to form a viable wall to accommodate the designed load.

Reinforcement rods, as normally used within concrete panels, will have been previously located at the desired location within the intended reinforcement areas, within the sculpted grooves, to add further structural strength to the skeletal concrete reinforcement, provided within the wall panel. The use of a vermiculite or lightweight concrete sheet, applied to the open side of the sculpted polystyrene slab, is to provide greater durability than the use of a polystyrene sheet, it adds greater fire resistance, and enhanced chemical resistance, particularly where these become priority issues in the design and fabrication of an industrial building.

Variations or modifications to the subject matter of this invention may occur to those skilled in the art upon reviewing the subject matter of this invention. Such modifications, if within the spirit of this invention, are intended to be encompassed within the scope of any claims to patent protection issuing upon this development. The description of the preferred embodiment provided herein is done so primarily for illustrative purposes only.

Having thus described the invention what is claimed and desired to be secured by Letters Patent is:

1. In a prefabricated polymer building or other structured wall panel formed at the factory, a sheet of foamed polymer, said sheet having sizable dimensions to form a significant part of a wall when assembled, said sheet having front and back surfaces, a series of grooves cut into one of said front and back surfaces of the sheet, and cut to a depth to form a significant groove within the said polymer sheet, said grooves cut within the formed polymer sheet to accommodate the fill of reinforcing concrete therein, a quantity of concrete applied into the cut grooves to fill the said grooves to capacity and to function as concrete reinforcement within the formed prefabricated wall panel, said sheet having another sheet formed at least of one of foamed polymer and lightweight concrete applied thereon and held thereto by one of an adhesive or fastener to form a prefabricated concrete reinforced wall, said sheet of foamed polymer being formed of one of polystyrene and polyurethane foam, the grooves within the sheet being cut at various angular relationships with respect to each other, and extending from one edge to the opposite edge of the wall panel, said grooves being arranged at approximately perpendicularly with respect to each other, and there being at least one reinforcing rod provided within each cut groove prior to its fill with concrete, each wall panel having a pair of side edges, and a connecting slot provided upon each of the side edges of the wall panel at opposite sides thereof and provided to accommodate the erection of a series of said wall panels into a building wall after transfer to the job site, and tee tracks placed along the edges of adjacent wall panels when erected for providing fastening surface to which various finishing materials may be applied.

2. The invention of claim 1 and wherein said sheet of lightweight concrete comprising vermiculite.

3. The invention of claim 1 and wherein each groove is cut in cross-section to the configuration of an I-beam.

4. The invention of claim 3 and wherein said edge disposed slots extending the full height or width of each formed wall panel.

5. The invention of claim 1 and wherein said cut grooves within the foamed polymer sheet being cut by the hot wire process.

6. The invention of claim 1 and wherein said concrete is located within the cut grooves after the lightweight concrete sheet is applied to the cut foamed polymer sheet.

7. The invention of claim 6 and including forms disposed around the peripheral edges of the cut foamed sheet to close the normally opened ends of the cut grooves during the pouring of lightweight concrete therein.

* * * * *